US006545949B1

(12) United States Patent
Franklin

(10) Patent No.: US 6,545,949 B1
(45) Date of Patent: Apr. 8, 2003

(54) AXIAL DRIVE RESONANT PIPE PROJECTOR (ADRPP)

(75) Inventor: J. Barrie Franklin, Dartmouth (CA)

(73) Assignee: Her Majesty the Queen in right of Canada, as represented by the Minister of National Defence, Ottawa (CA)

( * ) Notice: Subject to any disclaimer, the term of this patent is extended or adjusted under 35 U.S.C. 154(b) by 0 days.

(21) Appl. No.: 09/957,454

(22) Filed: Sep. 21, 2001

(51) Int. Cl.[7] ..... H04R 17/10; H04R 17/00

(52) U.S. Cl. ..... 367/176; 367/157; 367/162; 367/165; 310/337

(58) Field of Search ..... 181/113, 118, 181/120; 367/150, 165, 155, 157, 162, 176; 310/337

(56) References Cited

U.S. PATENT DOCUMENTS 4,922,470 A 5/1990 McMahon
5,047,997 A * 9/1991 Forsberg ..... 367/191
5,062,089 A * 10/1991 Willard et al. ..... 181/120
5,136,556 A * 8/1992 Obara ..... 367/163
5,184,332 A 2/1993 Butler
5,805,529 A 9/1998 Purcell
6,135,234 A 10/2000 Harris

FOREIGN PATENT DOCUMENTS

CA 1319414 6/1993

* cited by examiner

*Primary Examiner*—Ian J. Lobo
(74) *Attorney, Agent, or Firm*—Larson & Taylor, PLC

(57) ABSTRACT

An underwater acoustic projector comprising a pair of spaced apart end walls with an acoustic driver positioned between the end walls, the driver having smaller cross-sectional dimensions than the end walls. Each end wall close one end of open ended tubular pipe waveguides and is mechanically coupled to one end of a piezoelectric acoustic driver.

11 Claims, 4 Drawing Sheets

AXIAL DRIVE RESONANT PIPE PROJECTOR (ADRPP)

FIELD OF THE INVENTION

The present invention relates to acoustic projectors, especially projectors for use in low frequency military and civilian sonar systems, and in particular to underwater acoustic projectors having highly stable performance with depth and reduced manufacturing costs due to lower mechanical tolerances being required than in existing acoustic projectors.

BACKGROUND OF THE INVENTION

Low frequency military and civilian sonar systems require compact, light weight, high power, efficient, wide bandwidth acoustic projectors whose performance is stable with depth and linear with drive voltage levels and which have a low manufacturing and maintenance cost.

Canadian Patent 1,319,414 by Bryce Fanning et al that issued on Jun. 22, 1993 describes one type of a free-flooding piezoelectrically driven resonate-pipe projector (RPP) with vent holes in the pipe walls to broaden the response of certain cavity resonances and to increase the response between those resonances. The drive unit is a radially-poled lead zirconate-titanate cylinder with aluminum pipes extending into the center of the piezoelectric drive unit, the pipes being mechanically coupled to the drive unit. To accomplish the necessary acoustic coupling between the drive unit and pipes requires a close mechanically fit to couple the drive unit to the pipes. These resonant pipe projectors are partially free-flooding and can be operated at extreme depths because the drive unit is highly resistant to hydrostatic loading. However, the bandwidth is small and they are expensive to manufacture due to the high degree of tolerances required.

Flextensional projectors are amongst the best ones presently available to meet the military and civilian sonar systems requirements, one of the most promising flextensional projectors being the barrel stave type. The barrel stave projector (BSP) is a compact, low frequency underwater sound source which has applications in low frequency active (LFA) sonar and in underwater communications. In one known BSP design, such as described in U.S. Pat. No. 4,922,470 by G. McMahon et al, a set of curved bars (staves) surround and enclose a stack of axially poled piezo-electric rings. The staves act like a mechanical transformer and help match the impedance of the transducer to the radiation impedance of the water. Axial motion of the stave ends is transformed to a larger radial motion of the stave midpoints. This increases the net volume velocity of the water, at the expense of the applied force, and is essential for radiating effectively at low frequencies.

This known BSP projector has slots between the staves which are required to reduce the hoop stiffness and achieve a useful transformer ratio. However, these slots must be waterproofed by a rubber membrane (boot) stretched tightly and glued with epoxy around the projector. This boot also provides effective corrosion protection for the A1 staves. However, the variation in performance with depth of the BSP is suspected to depend in part on the boot. At increasing depths, hydrostatic pressure pushes the boot into the slots causing the shell to stiffen tangentially, increasing the resonance frequency, and causing an increasing loss of performance. This depth sensitivity of a barrel stave projector can be reduced somewhat by reinforcing the boot over the slots.

It is also possible to pressure compensate the BSP with compressed air or other gas resulting in good acoustic performance at greater depths.

The slots in the BSP, as a secondary effect, provide a nonlinearity in the response of the projector to hydrostatic loading. The staves will deflect inwards together under increasing hydrostatic loading (assuming no pressure compensation) since the projector is air filled. Depending on the thickness and stiffness of the rubber, it is reasonable to expect that as the slots close at great enough depths, that closure of the slots due to increasing depth will force the boot back out of the slots. The projector will now be very stiff and resistant to further effects of depth until the crush depth of the now, effectively, solid shell is reached. This provides a safety mechanism which may save the projector in case an uncompensated BSP is accidentally submerged very deep or a pressure compensation system runs out of air.

Variants of this known BSP have been built to optimise light weight, wide bandwidth, low frequency, high power, and improved electroacoustic efficiency. Efficiency is an especially critical parameter for the high power versions of the BSP because the driver is well insulated from the water thermally. The boot's relatively poor thermal conductivity contributes to the difficulty in cooling the BSP.

There is evidence that the interelement variability in performance amongst a set of 20 of these projectors used in a horizontal line array was due largely to variability in the boot's material properties Most of these projectors subsequently failed due to chemical incompatibility of the boots with the hydrocarbon-based towed-array fill fluid, underscoring the need for consideration of chemical compatibility whenever elastomer clad projectors are exposed to fluids other than seawater. The neoprene boot is a potential weak point for the BSP in terms of damage due to rough handling. Even a pinhole in the boot can lead to projector failure by flooding. Overhaul of a barrel stave projector usually involves boot replacement. The cost of a custom molded neoprene boot is approximately $20.00 but the labour cost of installing the boot is typically several person hours spread over 2 days (of glue curing time) contributing to the relatively high maintenance cost for these BSPs.

The inside surfaces of the (eight) staves of these BSPs are machined individually from bar stock on a numerically controlled (NC) milling machine. The staves are then mounted together on a fixture and the outside surfaces are turned on a tracer lathe. The machining and handling costs are such that the staves are the most expensive parts of the BSP. These BSPs are, as a result, both relatively costly to manufacture and maintain.

Since the radiating surface of this BSP is waterproofed with a rubber membrane, it is susceptible to chemical attack and degradation and damage due to flooding through pinholes. The BSP suffers from variation of performance with depth caused by water pressure forcing the rubber membrane into the slots between the vibrating staves of the projector unless a pressure compensation system is fitted. The BSP shows nonlinearity of performance versus drive voltage due to effects of the rubber membrane. Thus there could be substantial advantages to accrue if it were possible to develop a one-piece flextensional shell for the BSP that does not require a boot.

A one-piece flextensional shell projector is described by Christopher Purcell in U.S. Pat. No. 5,805,529. The surface of this projector is formed of a thin-walled one-piece inwardly concavely shaped shell containing corrugations running in the axial direction. This one-piece shell is slotless which eliminates the requirement for a boot.

SUMMARY OF THE INVENTION

It is an object of the invention to provide an acoustic projector with reduced depth sensitivity when submerged in water, improved efficiency and reduced manufacturing costs.

An acoustic projector, according to one embodiment of the present invention, comprises a pair of spaced apart end walls with an acoustic driver positioned between and connected to the end walls, the driver having smaller cross-sectional dimensions than the end walls which have tubular pipe waveguides extending outward from the driver, outer ends of the waveguides being open.

BRIEF DESCRIPTION OF THE DRAWINGS

The invention will now be described in more detail with reference to the accompanying drawings, in which.

DESCRIPTION OF THE PREFERRED EMBODIMENTS

Low frequency military and civilian sonar systems require compact, light weight, high power, efficient, wide bandwidth acoustic projectors whose performance is stable with depth and linear with drive voltage levels as well as being low in cost to manufacture and maintain.

Figure 1:
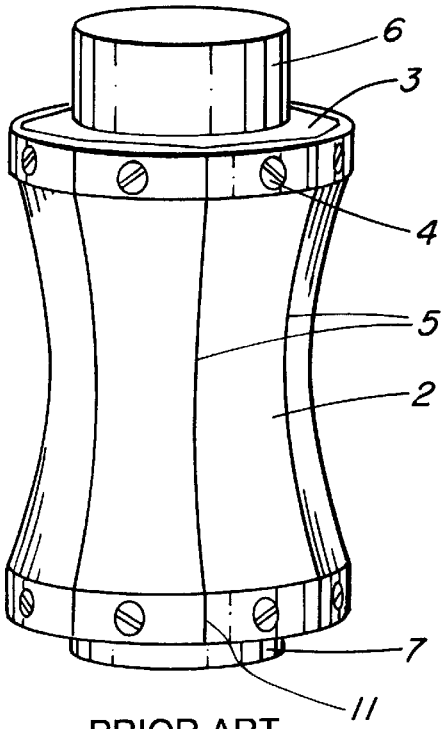
PRIOR ART FIG. 1
FIG. 1 is a perspective view of a known barrel-stave projector without a rubber boot.
Figure 2:
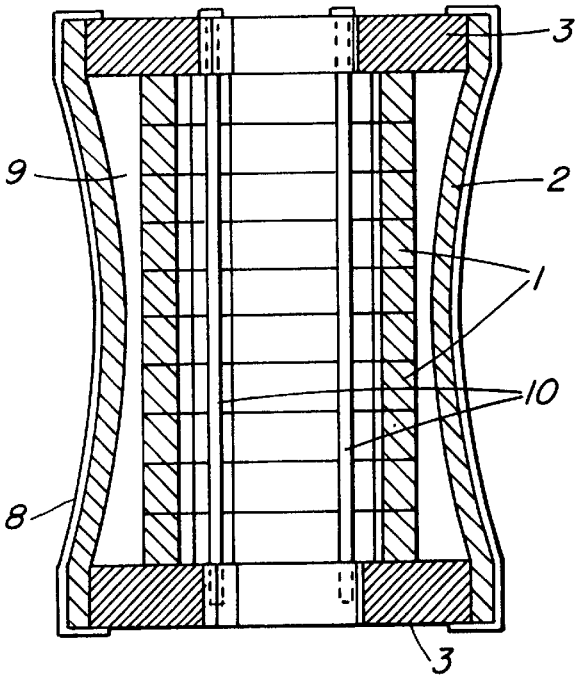
PRIOR ART FIG. 2
FIG. 2 is a cross-sectional view along a longitudinal axis of FIG. 1 with a rubber boot in place but without the upper and lower end caps shown in FIG. 1.

Flextensional projectors are amongst the best ones presently available to meet the requirements for military and civilian sonar systems. One type of flextensional projector, known as the barrel stave projector (BSP), is described in U.S. Pat. No. 4,922,470 by G. W. McMahon et al. This barrel stave projector, illustrated in FIGS. 1 and 2, contains a driver 1 formed of a stack of axially poled piezo-electric ceramic rings and an enclosure formed by a set of curved bars (staves) 2 with polygonal end plates 3. The staves 2 are secured to flat sides of the octagonal end plates 3 with an adhesive (epoxy resin) and screws 4 retained in threaded holes in the end plates. Caps 6 and 7 cover openings in end plates 3.

Axial motion of the stave ends is transformed to a larger radial motion of the staves midpoints. Slots 5 between the staves 2 are required to reduce the hoop stiffness and achieve a useful transformer ratio. Those slots 5 must be waterproofed by a rubber membrane (boot) that is stretched tightly around the projector and glued with epoxy. This boot 8 (shown in FIG. 2) is used for sealing purposes and may be formed of a rubber membrane which, for variants designed for operation near $1KH_z$, is about 1 mm thick. It also provides corrosion protection for the A1 staves used in these types of BSPs.

The rubber membrane (boot) 8 which waterproofs the radiating surface of the BSP is, however, susceptible to chemical attack and degradation with resulting damage due to flooding through pinholes.

These BSPs also suffer from variation of performance with depth caused by water pressure forcing the rubber membrane into the slots between the vibrating staves of the projector unless a pressure compensation system is included. In addition, these BSPs exhibit non-linearity of performance versus drive voltage due to the effects of that rubber membrane.

Figure 3:
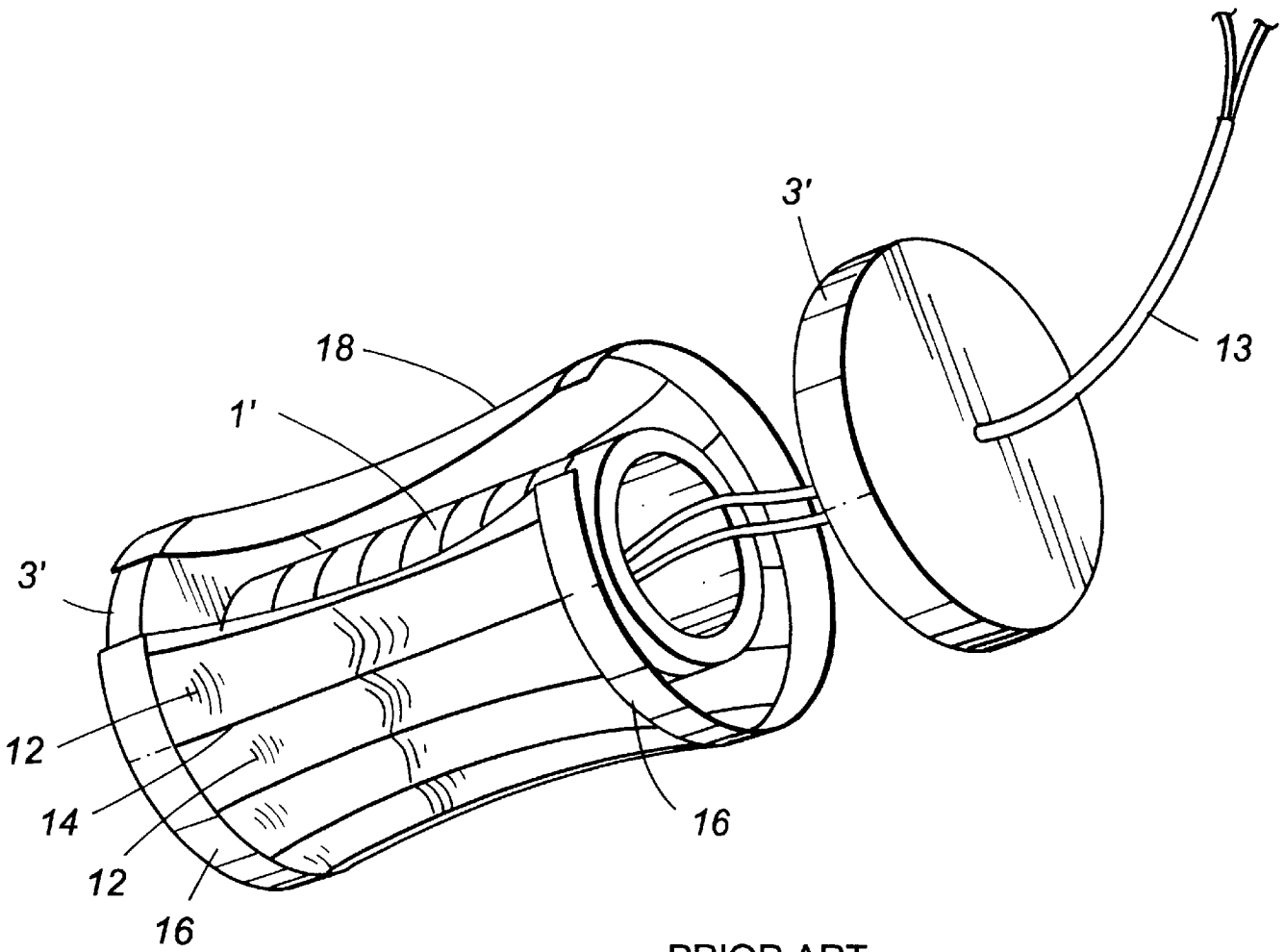
PRIOR ART FIG. 3
FIG. 3 is a perspective view of a known folded shell projector with one fold being removed to illustrate its interior.

Another flextensional acoustic projector is described by Christopher Purcell in U.S. Pat. No. 5,805,529. This projector has a one-piece slotless flextensional shell for an underwater acoustic projector which is inwardly concavely shaped similar to the BSP but which does not require any boot The one-piece shell has no gaps or openings in its outer surface. This shell achieves the required low hoop stiffness for low frequency operation by using folds rather than slots as used in the BSP. This Folded Shell Projector's (FSP) surface is formed of a thin-walled one-piece inwardly concavely shaped shell containing corrugations (folds) running in the axial direction. The basic concept of such a FSP is illustrated in FIG. 3 with one fold removed to show the inner piezoelectric driver 1'. The thin-walled folded shell 18 is inwardly concavely shaped with a number of axially extending corrugations having valleys 12 and ridges or cusps 14. The corrugations extend between end flanges 16' which are intended to be connected to end caps 3'. Leads 13 extend from the piezoelectric driver 1' through a central opening in one of the end caps 3'. The thin shell provides a waterproof enclosure for the driver in this type of projector but tight tolerances are required during the manufacture of this projector.

Figure 4:
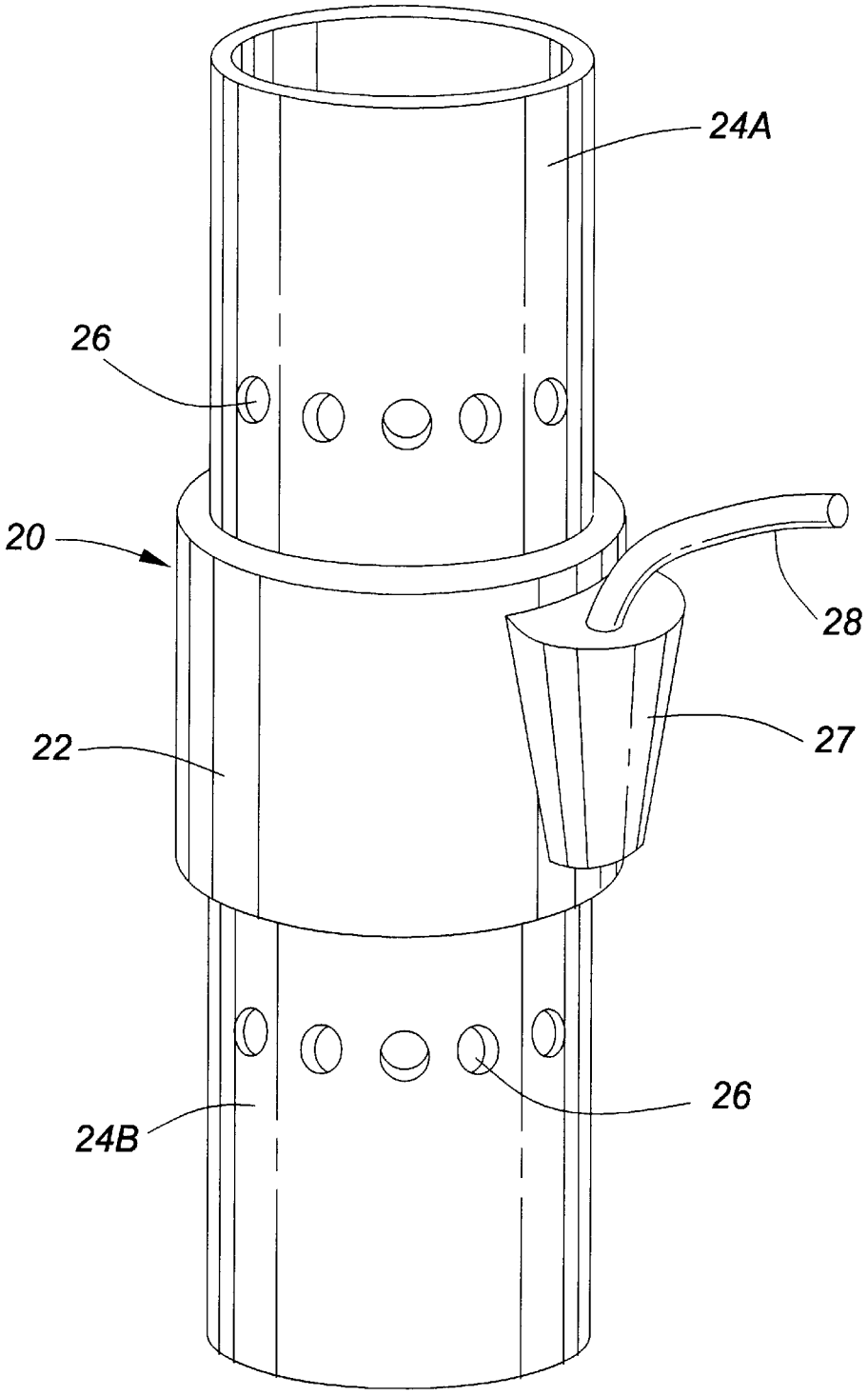
PRIOR ART FIG. 4
FIG. 4 is a perspective view of a known resonant pipe projector.

Canadian Patent 1,319,414 by Bruce Fanning et al which issued on Jun. 22, 1993 describes one known type of a partially free-flooding piezoelectric driven resonate pipe projector (RPP) which is illustrated in FIG. 4. This RPP 20 contains vent holes 26 in the pipe walls 24A and 24B to broaden the response of certain cavity resonances and to increase the response between those resonances. The drive unit 22 is a radially-poled lead zirconate-titanate cylinder with the aluminum pipes 24A and 24B extending into that cylinder where they are mechanically coupled to the inner surface of the drive unit. To accomplish the necessary acoustic coupling between the drive unit 22 and the pipes requires a close mechanical fit between those parts. This type of RPP are partially free-flooding and can be operated at extreme depths since the drive unit is highly resistant to hydrostatic loading. However, their bandwidth is small and they are expensive to manufacture due to the high degree of mechanical tolerances required.

Figure 7:
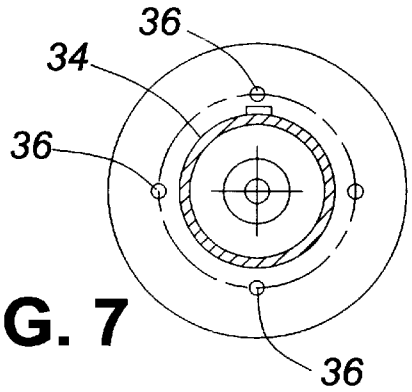
FIG. 7 is a cross-sectional view along line A—A in FIG. 5.
Figure 6:
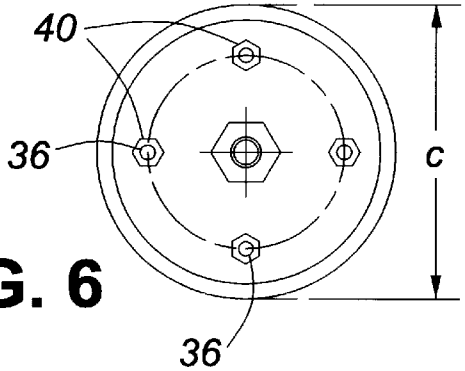
FIG. 6 is an end view of the projector shown in FIG. 5.

An axial driven resonant pipe projector (ADRPP) according to the present invention is a partially free-flooding acoustic projector that can be operated at extreme depths because the piezoelectric drive unit is highly resistant to hydrostatic loading. This ADRPP has a balanced pair of free flooded pipes (waveguides) with opposed open ends and integral end walls connected to a piezoelectric drive unit with pre-stress rods holding the end places against the drive unit. This ADRPP is best illustrated in the cross-sectional view of FIG. 5 with FIG. 6 being an end view of the ADRPP projector 30 and FIG. 7 being a cross-sectional view along section A—A of the drive portion. This ADRPP is lightweight, compact and inexpensive to manufacture because the drive motor does not have co precisely fit the outside circumference of a resonant pipe as required in other RPPs such as those described in Canadian Patent 1,319,414.

Figure 5:
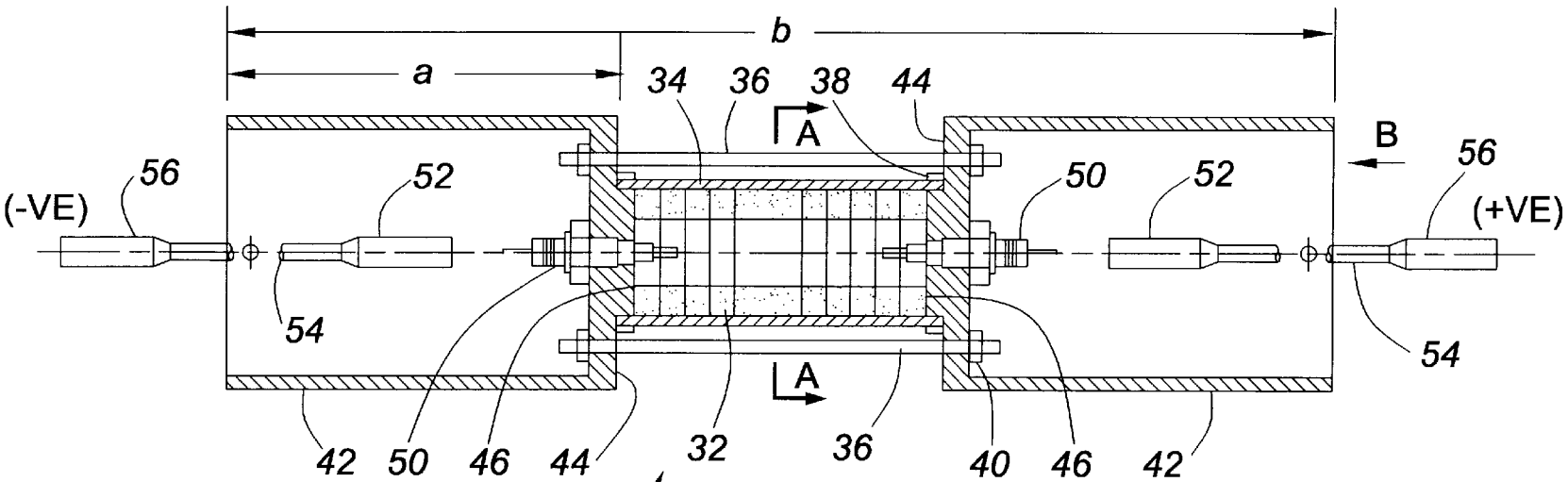
FIG. 5 is a cross-sectional view of an acoustic resonant pipe projector according to one embodiment of the present invention.

The axial driven resonant pipe projector 30 illustrated in cross-section in FIG. 5 contains a 12 ring ceramic stack piezoelectric drive element 32, the rings having nominal dimensions of 2 inch outer diameter, 0.4 inch axial length and 0.505 inch wall thickness. To water-tight seal the stack 32 from sea-water, a 0.075 inch thick neoprene boot 34 was used to isolate the active components and it is bonded to the stack 32 by restraining clamps 38 clamped on the central boss 46 of the end walls 44 at either end of the stack 32. An alternative to the neoprene boot is that one or more drive motors may be waterproofed by a coating. Although a stack of 12 ceramic rings are shown in FIG. 5, that number may be varied or a single piezoelectric cylinder used.

The waveguides 42 at opposite ends of the stack 32 consists of tubular pipes with open ends facing away from stack 32 and integrally formed end walls 44, each end wall has a central boss 46 that presses against the ends of stack 32. That boss 46 serves a dual purpose in that (1) it serves to increase the wall thickness to maintain peak operational bending stresses in the end-wall below the endurance limit of the aluminum end wall and (2) it facilitates the water-tight sealing of the neoprene boot 34 to stack 32. The end walls 44 are shown as being integrally formed with the tubular pipes but these could be formed separately and the central bosses 46 would not be necessary when the drive element is waterproofed with a coating rather than a boot. The waveguides 42 in a prototype projector were machined from solid stock Aluminum 6061-T6 with an outer diameter c (see FIG. 6) of 4.5 inches and a nominal wall thickness of 0.25 inches. The base of the waveguides, i.e. end walls 44, were 0.5 inches thick with a central boss 46 having a height of 0.25 inches and a 2 inch diameter.

Electrical connectors 50 extend through a central opening in the central boss 46 and are connected to the ceramic rings in stack 32. The connectors 50 are sealed in a water proof manner to the end walls 44 and are connected to an insulated conductor 54 via a connector 52.

Four stress rods 36 extend through aligned openings in the two end walls 44 (see FIGS. 5 and 6) and locknuts 40 at each end of the stress rods press the end walls 44 towards each other and against the ceramic ring stack 32. The stress rods 36 are put into tension by the locknuts 40 and the ceramic stack 32 into compression at the time of manufacture. In the prototype unit, the four stress rods in this unit were threaded rod grade 8 alloy steel (yield strength of 120 ksi) with the locknuts 40 being appropriate Grate 8 high strength nylon insert locknuts. This allowed the axial stiffness of the stress rods to be kept at about 12% of the ceramic stack and the level of prestressing at 1.25 times the peak dynamic load in the stack.

The projector according to the present invention is lightweight, compact and inexpensive to manufacture compared to other resonant pipe projectors. The tuning of the longitudinal mode of this projector may be achieved by varying the length of the waveguides, the length of the motor, the end wall dimensions and the material properties. To lower the frequency of the operational band, low sound speed fluids may be sealed into the waveguide volumes by means of a flexible membrane covering their ends. The projector does have a narrow bandwidth but narrow bandwidth projectors are relative easy to power efficiently and, therefore, are highly suited to low costs battery operated expendable applications where a highly efficient sonar system (including amplifier, transformer and projector) is required.

Various modifications may be made to the preferred embodiments without departing from the spirit and scope of the invention as defined in the appended claims.

The embodiments of the invention in which an exclusive property or privilege is contained is claimed are defined as follows:

1. An underwater acoustic projector comprising a pair of spaced apart end walls with an acoustic piezoelectric driver positioned between the end walls, the driver having smaller cross-sectional dimensions than the end walls, the end walls having tubular resonant pipe waveguides extending outward from said driver, and each of said resonant pipe waveguides having an open outer end.

2. An underwater acoustic projector as defined in claim 1, wherein the end walls contain apertures and stress rods with threaded ends extend through aligned ones of said apertures in the spaced apart end walls, locknuts on threaded portions of the stress rods pressing the end walls towards each other and against the acoustic piezoelectric driver.

3. An underwater acoustic projector as defined in claim 2, wherein the acoustic piezoelectric driver comprises a stack of piezoelectric rings and each end wall has a circular central boss that extends towards and presses against said stack.

4. An underwater acoustic projector as defined in claim 3, wherein said stack is surrounded by a waterproof boot having each end fastened to one of said central bosses by a circular clamp that surrounds said one of said central bosses and an associated end of said boot.

5. An underwater acoustic projector as defined in claim 4, wherein an electrical connector extends through a central opening in each boss to provide electrical connections to said rings, each connector being sealed to an associated end wall in a waterproof manner.

6. An underwater acoustic projector as defined in claim 1, wherein the acoustic piezoelectric driver comprises a stack of piezoelectric rings and each end wall has a circular central boss that extends towards and presses against said stack.

7. An underwater acoustic projector as defined in claim 6, wherein said stack is surrounded by a waterproof boot having each end fastened to one of said central bosses by a circular clamp that surrounds said one of said central bosses and an associated end of said boot.

8. An underwater acoustic projector as defined in claim 7, wherein an electrical connector extends through a central opening in each boss to provide electrical connections to said rings, each said connector being sealed to an associated end wall in a waterproof manner.

9. An underwater acoustic projector comprising a pair of spaced apart end walls and an acoustic piezoelectrical driver positioned between the end walls, the driver having smaller cross-sectional dimensions than the end walls, stress rods with threaded ends extending through aligned apertures in the spaced apart end walls and locknuts on threaded portions of the stress rods pressing the end walls towards each other and against the acoustic piezoelectric driver, each said end wall having a circular central boss that extends towards and presses against one end of the driver, said projector further comprising a waterproof boot surrounding the driver, and each end of the waterproof boot being fastened to one of said central bosses by a circular clamp that surrounds said one of said central bosses and an associated end of the boot.

10. An acoustic projector as defined in claim 9, wherein at least one of said end walls has an open ended tubular resonant pipe waveguide extending outward from said driver.

11. An acoustic projector as defined in claim 10, wherein each of said end walls has an integrally formed tubular resonant pipe waveguide extending outward from said driver.

* * * * *